United States Patent [19]

Turcott

[11] 4,267,996

[45] May 19, 1981

[54] BAG HOLDER APPARATUS

[76] Inventor: Joseph A. Turcott, 107 Aspen Cir., Leesburg, Fla. 32748

[21] Appl. No.: 925,541

[22] Filed: Jul. 13, 1978

[51] Int. Cl.[2] ..... A63B 55/04

[52] U.S. Cl. ..... 248/97

[58] Field of Search ..... 248/94, 97, 99, 100, 248/101; 220/404

[56] References Cited

U.S. PATENT DOCUMENTS

| | | | |
|---|---|---|---|
| 666,516 | 1/1901 | Greene | 248/97 |
| 1,694,079 | 12/1928 | Nicholas | 248/97 |
| 1,971,642 | 8/1934 | Champlin | 248/97 |
| 3,222,019 | 12/1965 | Weisberg | 248/100 X |
| 3,633,859 | 1/1972 | Vosbikian | 248/97 |
| 3,756,548 | 9/1973 | Santarelli | 248/99 X |

*Primary Examiner*—William H. Schultz

[57] ABSTRACT

A supporting stand for holding open end leaf bags, or the like, in an open position has first and second base members rotatably attached to each other and each base member has a resilient leg attached to each end portion thereof. The base members can be locked into an open position with the legs extending upward from the base member and each pair of legs can be bowed inward to engage the folded lip of a leaf bag, which then stretches the bag open. Each leg has a protective tip to frictionally engage the bag and prevent tearing a hole therein, and the bases may be rotated into a folded position for storage.

10 Claims, 4 Drawing Figures

BAG HOLDER APPARATUS

BACKGROUND OF THE INVENTION

The present invention relates to a supporting stand for holding open end leaf bags in an open position and which will accomodate a variety of bag sizes and which may be folded for storage.

It has been common to use leaf and trash bags for loading leaves, trash, garbage, and the like, which are filled and the tops tied for pickup by the trash company. Such bags are sold in a folded condition with wire ties and must be opened and held open while the bag is loaded with trash. This has presented a great deal of trouble and works best with one person holding the bag open while the other loads the leaves or trash into the bag. To overcome this difficulty, a variety of stands have been provided for holding the bag open while loading, and which may be removed from the stand, the opening tied shut, and the stand re-loaded with an additional bag. Typical prior art patents in this area may be seen in U.S. Pat. No. 2,140,995 for a refuse disposal device for vacuum cleaner bags which has a base, four legs and a top connected to the legs. This, however, is a rigid stand which does not provide for easy storage when not in use. U.S. Pat. No. 1,356,142 teaches a bag holder for holding bags open during loading, which has four legs attached to a hoop so that the legs can sit on the ground and the bag attached to the hoop with cords or the like. U.S. Pat. No. 3,604,677 for a bag holder provides for driving stakes into the ground and attaches a hoop thereto for placing a folded end of an open bag thereon. U.S. Pat. No. 3,095,172 teaches a bag holding rack having tubular rods forming a base, legs and a bag holding portion for stretching the bag thereover, while U.S. Pat. No. 3,627,242 has legs and a pair of circular bars connected to the legs to allow the bag to be positioned over the top circle in an open position for filling. U.S. Pat. No. 3,352,520 has a bag holder for mounting to a cabinet door or wall for holding a flexible bag therein and also provides a top.

In contrast to the prior art, the present invention provides an easily manufactured supporting stand for holding open end leaf bags in an open position which may be easily folded for storage when not in use. The supporting stand advantageously has flexible legs which stretch the bags open and thereby allow a wide variety of bag sizes to be used with the same stand.

SUMMARY OF THE INVENTION

A supporting stand for holding open end leaf or trash bags in an open position has a first base member having a resilient leg attached to each end portion thereof and a second base member having a resilient leg attached to each end portion thereof with the first and second base members rotatably attached together, one base member being shorter than the other so that legs and base members can be folded flat. The base members may be rotated into a supportive position with the base members approximately perpendicular to each other and locked in that position, which may be set on the ground, and the legs may have tips formed thereon for frictionally engaging the folded lip of a leaf bag without tearing the bag, so that the legs can be bowed inward to engage a variety of sizes of open end bags to stretch the open end open by the bias of the resilient legs pulling the bags outward.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
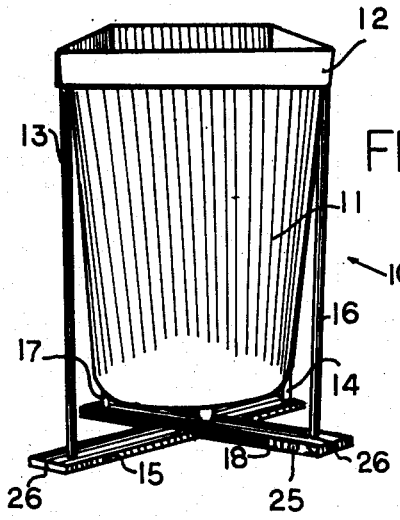
FIG. 1 is a perspective view of a supportive stand for holding open end bags in an open position having a bag attached thereto.

Referring now to all of the drawings, and especially to FIG. 1, a supporting stand 10 for holding open end leaf or trash bags, or the like, in an open position has a bag 11 held open by having the open end lip 12 folded over the tip of a pair of legs 13 and 14 connected to a base member 15 and a pair of legs 16 and 17 connected to a base member 18. Each of the legs has an enlarged rubber tip 20 attached to the tip thereof so that the bag 11 lip 12 can be frictionally engaged by the rubber tip 20 to give added frictional engagement between the lip and the bag, and also to prevent the tip of the legs 13, 14, 16 and 17 from tearing the bags. The legs 13, 14, 16 and 17 are made of a resilient material, such as fiberglass rods, and are attached in openings in the base members 15 and 18 to protrude outwardly at an angle from the ends of the base members. This allows each of the legs to be bowed inward as in FIG. 1 to engage the lip 12 of the bag 11 which may be any variety of sizes since the legs can be bowed in different degrees to engage the lips, which will then spring back against the lip 12 to hold the bags in open position. The legs 13, 14, 16 and 17 are held in holes having saw cuts 26 to the leg holes and self-tapping thumb screws 25 for tightening the legs to the base members 15 and 18.

Figure 2:
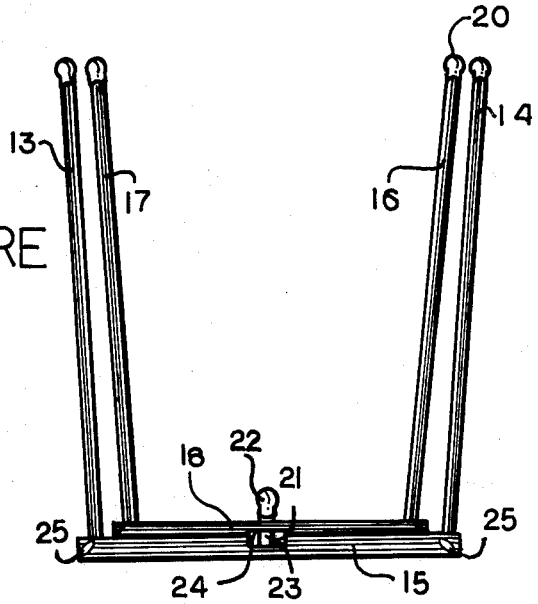
FIG. 2 is an elevational view of the supportive stand of FIG. 1 in a folded position.
Figure 3:
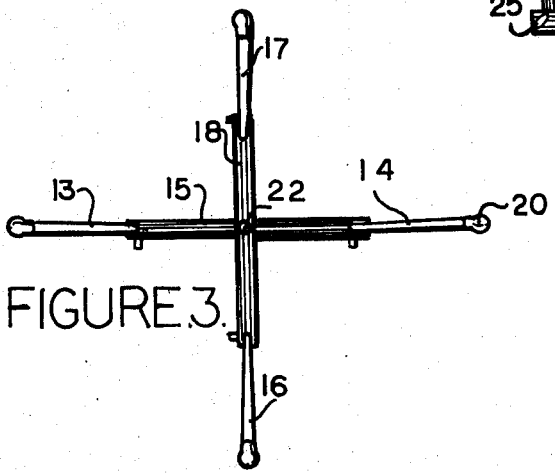
FIG. 3 is a top elevation of the supportive stand of FIGS. 1 and 2.
Figure 4:
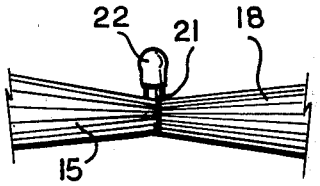
FIG. 4 is a cutaway sectional view of the base members locked together in open position as in FIGS. 1 and 3.

In operation, two legs are bowed in to engage the lip of the bag and then released to stretch the bag out in one direction and the other two legs are then bowed in and placed under the lip and released to stretch the bag in the other direction. FIG. 2 shows that the base member 18 is shorter than base member 15 to allow the rotatable connection 20 between the base members 15 and 18 to be rotated one on top of the other to allow the members to be folded flat. The members are connected by a connecting shaft 21 which has an enlarged rubber tip 22 on the end thereof so as to prevent the tearing or puncturing of the bag 11 if the bag 11 is large enough that its bottom would fall upon the protruding portion of the shaft 21. Base member 15 has a notched portion 23 which is the width of the base member 18, while base member 18 has a notched portion 24 which is the width of the base member 15, so that when the members are rotated perpendicular to each other, as shown in FIG. 3, the notched portions fall into each other with base member 18 sliding on the shaft 21 to lock the members in a position generally perpendicular to each other, as shown in FIGS. 4 and 1. To release the base members requires only that the base member 18 be lifted and rotated to the position of FIG. 2 for storage. While other locking systems are contemplated as being within the scope of the invention, the present means of locking the base members 15 and 18 allows the supporting stand to be inexpensively produced with base members 15 and 18 being made of wood and the shaft 21 can also be made of wood, while the legs can be made of fiberglass, wood, aluminum or any material desired. Once the bag 11 has been fully loaded, the lip 12 is simply disengaged from the legs 13, 14, 16 and 17 and the openings of the bag tied closed and another bag attached. It should be clear at this point that a supporting stand for holding open end leaf bags has been provided but the form shown should be considered illustrative rather than restrictive.

I claim:

1. A supporting stand for holding open leaf bags or the like in an open position comprising in combination:

a first base member;

a first pair of resilient legs connected to said first base member, one leg on each end portion of said base member;

a second base member;

a second pair of resilient legs connected to said second base member, one leg on each end portion of said base member;

attaching means for movably attaching said first and second base members so that one base member can be rotated on the other from a folded to a supportive position;

locking means for locking said first and second base members generally perpendicular to each other in a supportive position; and bag engaging tips formed on each end of each of said first pair and each of said second pair of legs, whereby said first and second base members can be positioned in a supportive position with their legs extending therefrom and said legs bowed to engage a folded lip of a leaf bag, or the like, with said bag engaging tips to hold said bag open end open with the bias of said bowed legs.

2. The supporting stand in accordance with claim 1, in which said first and second pair of legs are fiberglass rods.

3. A supportive stand in accordance with claims 1 or 2 in which said bag engaging tips are enlarged rubber tips frictionally attached to one end of each of said first and second pair of resilient legs.

4. A supportive stand in accordance with claim 2 in which said first base member has a notched portion cut on one side thereof at least as wide as said second base member and said second base member has a notched portion on one side thereof at least as wide as said first base member whereby said first and second base members can be rotated for said notched sides to slip into each other.

5. The supporting stand in accordance with claim 4 in which a shaft extends through said first and second base members centered on said notched portion of said first and second members to rotatably hold said first and second base members together.

6. A supporting stand in accordance with claim 5 in which said shaft connecting said first and second supporting members has an enlarged protective covering on one end to prevent damage to the bottom of a bag attached to said supporting stand.

7. The supporting stand in accordance with claim 4 in which said first base member is shorter than said second base member so said first and second members may be rotated one on top of the other with said first pair of resilient legs positioned inside said second pair of resilient legs to fold said supporting stand flat.

8. A supporting stand in accordance with claim 6 in which said first base member and second base member may be separated by sliding said first base member on said shaft.

9. A supporting stand in accordance with claim 4 in which said first and second base members are wooden members in a rectangular cross-section.

10. The supporting stand in accordance with claim 1 in which said first base member has means for tightening said first pair of legs thereto and said second base member has means for tightening said second pair of legs thereto.

* * * * *